US010765273B1

(12) United States Patent
Work et al.

(10) Patent No.: US 10,765,273 B1
(45) Date of Patent: Sep. 8, 2020

(54) SPINDLE FOR PAPER ROLLS

(71) Applicant: American Paper Converting Inc., Woodland, WA (US)

(72) Inventors: Lydia M. Work, Kalama, WA (US); Jorge A. Tunnermann, Santa Ana, CA (US)

(73) Assignee: American Paper Converting Inc., Woodland, WA (US)

( * ) Notice: Subject to any disclaimer, the term of this patent is extended or adjusted under 35 U.S.C. 154(b) by 210 days.

(21) Appl. No.: 15/957,774

(22) Filed: Apr. 19, 2018

Related U.S. Application Data

(60) Provisional application No. 62/588,084, filed on Nov. 17, 2017.

(51) Int. Cl.
*A47K 10/40* (2006.01)
*B65H 75/08* (2006.01)
*A47K 10/32* (2006.01)

(52) U.S. Cl.
CPC ..... *A47K 10/405* (2013.01); *B65H 75/08* (2013.01); *A47K 2010/3206* (2013.01); *B65H 2701/1846* (2013.01)

(58) Field of Classification Search
CPC ..... A47K 10/38; A47K 10/405; A47K 2010/3206; B65H 75/08; B65H 75/18; B65H 75/22; B65H 2701/1846
USPC ..... 242/599.1
See application file for complete search history.

(56) References Cited

U.S. PATENT DOCUMENTS 1,495,302 A * 5/1924 Hartshorne ..... B65H 75/18 242/118.32
2,238,191 A * 4/1941 Shelton ..... G03B 17/305 242/358.1
2,889,122 A * 6/1959 McConnell ..... A47K 10/40 242/599.1
3,170,652 A * 2/1965 Kennedy ..... A47K 10/40 242/599.1
3,362,653 A * 1/1968 Carlisle ..... A47K 10/32 242/599.1
5,669,576 A * 9/1997 Moody ..... A47K 10/38 242/560.3
5,758,843 A * 6/1998 Ongaro ..... A47K 10/3836 242/563.2
9,635,986 B2 * 5/2017 Phelps ..... A47K 10/40
2002/0134881 A1 * 9/2002 Hoernig ..... A47K 10/40 242/599.1

(Continued)

OTHER PUBLICATIONS

Spindles 11, 12s and 13—prior art—more than one year prior to the filing date of the present application.

*Primary Examiner* — William A. Rivera
(74) *Attorney, Agent, or Firm* — Klarquist Sparkman, LLP

(57) ABSTRACT

A spindle assembly for supporting a roll of paper product is disclosed with features that make the spindle versatile and useable for supporting paper product rolls in a plurality of styles of dispensers. The spindle assembly also includes features that assist in maintaining the supported paper rolls in a desired orientation, such as horizontally in a vertically oriented dispenser. This resists skewing of the rolls in the dispenser and facilitates the separation of the rolls as paper is used from a lower roll in a dispenser. Also, brake members are provided to engage the core of a supported roll of paper to slow down the rotation of the roll of paper when pulled upon by a user.

17 Claims, 3 Drawing Sheets

(56) References Cited

U.S. PATENT DOCUMENTS

2006/0217820 A1* 9/2006 Holt ..... A47K 10/40
700/46

* cited by examiner

SPINDLE FOR PAPER ROLLS

CROSS REFERENCE TO RELATED APPLICATION

This application claims the benefit of U.S. Provisional Application Ser. No. 62/588,084, entitled SPINDLE FOR PAPER ROLLS, filed on Nov. 17, 2017, which is incorporated by reference herein.

FIELD

This disclosure relates to spindles for supporting a roll of paper products in a dispenser, such as toilet paper and paper towels.

BACKGROUND

Spindles for supporting paper product rolls in a dispenser are known.

However, known spindles often lack versatility as they are often dispenser specific and usable in only one brand or type of dispenser.

In addition, some prior spindles become skewed when used in plural roll dispensers, making it more difficult to retrieve paper from the dispenser.

Therefore, for these and other reasons a need exists for improve paper roll spindles.

SUMMARY

A spindle assembly for supporting a roll of paper product is disclosed with features that make the spindle versatile and useable for supporting paper product rolls in a plurality of styles of dispensers. A combination of rings and spindle portions of differing cross sectional dimensions, such as of different diameters, are positioned in a way that allows the spindle assembly to be received in different dispensers. The spindle assembly also includes features that assist in maintaining the supported paper rolls in a desired orientation, such as horizontally in a vertically oriented dispenser. This resists skewing of the rolls in the dispenser and facilitates the separation of the rolls as paper is used from a lower roll in a dispenser. As a desirable example, a spring biases enlarged end portions, such as respective rings, at the outer ends of rod and sleeve portions of a spindle assembly that are positioned within a dispenser slot against surfaces of the dispenser to assist in retaining the spindle assembly and supported paper roll in the desired orientation.

A brake can be incorporated into the spindle to increase friction between a supported paper roll and the spindle to reduce the tendency of the roll to over spin and dispense excess paper when the exposed end of the paper roll is grabbed and pulled by a user.

The paper roll can be supported on the spindle assembly between a first large ring on the sleeve portion and a second large ring on a rod portion. The sleeve portion includes a rod receiving passageway and the rod portion includes a rod body with a distal end portion sized for insertion into the rod receiving passageway. A biasing spring within the rod receiving passageway is compressed as the distal end portion of the rod body is inserted into the rod receiving passageway. By varying the depth of insertion of the distal end portion into the rod receiving passageway, the axial length of the spindle assembly is varied such that the assembly can be used in dispensers of different widths.

In accordance with more specific aspects of an embodiment of this disclosure, a spindle assembly is disclosed for supporting a roll of paper product in a paper product dispenser, the roll of paper product having a spindle receiving core with an inner core diameter. The spindle assembly can comprise a sleeve body having first and second sleeve body ends and a sleeve body longitudinal axis, the sleeve body having a rod receiving passageway extending through the first sleeve body end and axially into the sleeve body. In addition, a first ring extends outwardly from the sleeve body and has a first outer diameter. The first ring is positioned between the first and second sleeve body ends and nearer to the second sleeve body end than to the first sleeve body end. The spindle assembly of this embodiment can comprise a second ring that extends outwardly from the sleeve body and that is positioned at the second sleeve body end. The second diameter can be less than the first outer diameter. In addition, in this embodiment, the portion of the sleeve body between the first and second rings can have an outer diameter that is less than the second outer diameter. A biasing spring is also positioned within the rod receiving passageway. In addition, the embodiment includes a rod body having first and second rod body ends and a rod body longitudinal axis. A third ring can extend outwardly from the rod body and can have a third outer diameter, the third ring being positioned between the first rod body end and the second rod body end and nearer to the second rod body end than to the first rod body end. At least one fourth ring can extend outwardly from the rod body between the first rod body end and the third ring and the at least one fourth ring can have a fourth outer diameter that is less than the third outer. In this embodiment, a fifth ring extends outwardly from the rod body and can have a fifth outer diameter; the fifth ring being located at the second rod body end and the fifth outer diameter can be less than the third outer diameter. Furthermore, in this embodiment, the portion of the rod body between the third and fifth rings can have an outer diameter that is less than the fifth outer diameter. Moreover, the rod body can comprise a spindle rod portion between the at least one fourth ring and the first end of the rod body. The first end of the rod body also comprises a first end of the spindle rod portion. The first end of the spindle rod portion and the spindle rod have a cross sectional dimension that is sized to permit sliding of the spindle rod portion into and along the rod receiving passageway upon assembly of the sleeve body and rod body into the spindle assembly, the first end of the spindle rod portion engaging the biasing spring and compressing the engaged biasing spring as the spindle rod portion is inserted into the rod receiving passageway, the compressed biasing spring applying a force that urges the second and fifth rings away from one another and against portions of the dispenser.

In accordance with additional aspects of this disclosure, the spindle assembly can have first and third rings with respective first and third outer diameters that are equal to one another. In addition at least a portion of the sleeve body between the first ring and the first sleeve body end can have an outer diameter that is equal to the fourth outer diameter.

As a further aspect of this disclosure, a spindle assembly can have a sleeve body between the first ring and first sleeve body end, apart from any openings or recesses formed in the sleeve body, is a right cylinder.

As yet another aspect of this disclosure, each of the rings of the spindle assembly can be annular, coaxial and have a geometric center intersected by the longitudinal axis of the assembled spindle assembly. These rings can project perpendicularly outwardly from the longitudinal axis.

As a further aspect of this disclosure, the spindle assembly desirably includes at least one brake element or member positioned to engage the interior core of a paper roll when positioned on the spindle. The brake element provides friction against the interior core of the paper roll and limits the rate of rotation of the paper roll when a user engages and pulls on the end of the paper roll. The brake member can be annular and desirably has a cross sectional dimension that is less than the cross-sectional dimension of the paper roll core. Desirably there is at least one brake member positioned on each of the rod body and sleeve body. The brake member on the sleeve body is desirably positioned between the first ring and the first sleeve body end. In addition, the brake member on the rod body is desirably positioned between the third ring and the first rod body end and more desirably between the fourth ring and the first rod body end. The brake members can comprise elastomeric members, such as rings. O-rings or O-bands are a specific example. In one specific form, each of the brake members comprises a plurality of O-rings of rubber that are positioned side by side on the respective sleeve and rod bodies. For example, each brake member can comprise a set of three O-rings. The brake members can be held axially in position by adhesive. Alternatively, they can be positioned in a seat with respective wall portions at the axial ends of each seat. The seats can comprise a recess in the sleeve body. In addition, the seat in the rod body can be positioned in a portion of the rod body that is enlarged in cross-sectional dimension, such as an annular portion spaced from the first end of the rod body that has the same diameter as the fourth ring. The distal end of the rod body seat nearest to the first end of the rod body can be tapered, such as frustoconical, to facilitate insertion into the interior of the paper roll. In addition, the first end or distal end of the sleeve body can also be tapered, such as frustoconical for the same reason.

Desirably, the distal end of the sleeve body and the distal end of the rod body are spaced apart by a gap when the spring is fully compressed.

In accordance with an embodiment, the dispenser can comprise a toilet paper dispenser comprising a housing having a first side wall with a first channel mounted to the first side wall and a second side wall opposed to the first side wall, a second channel being mounted to the second side wall, the first channel having a first spindle receiving slot and the second channel having a second spindle receiving slot facing the first spindle receiving slot, the second spindle receiving slot being spaced from the first spindle receiving slot by a spacing distance that is less than the distance between the second end of the sleeve body and the second end of the rod body when the spindle rod portion is inserted into the rod receiving passageway and the spindle rod portion has not compressed the spring, the spacing distance also being greater than the distance between the second end of the sleeve body and the second end of the rod body when the spindle rod portion is inserted a maximum distance into the rod receiving passageway and compresses the spring. A toilet paper roll is carried by the spindle assembly with a first ring being positioned between the first channel and the toilet paper roll and a third ring being positioned between the second channel and the toilet paper roll. The toilet paper roll is thus positioned between the first and third rings and supported by brake elements between the first and third rings. In addition, second and fifth rings of the spindle assembly are respectively positioned in the first and second slots to load the toilet paper dispenser with the roll of toilet paper. A biasing spring urges the second and fifth rings against surfaces of the channels or of the dispenser to hold the toilet paper roll in a desired orientation in the dispenser.

The foregoing and other objects, features, and advantages of the invention will become more apparent from the following detailed description, which proceeds with reference to the accompanying figures.

DETAILED DESCRIPTION

Figure 1:
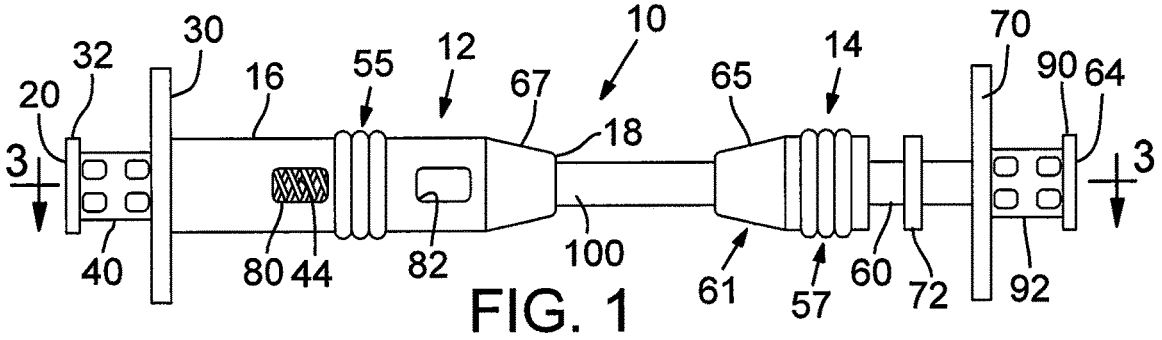
FIG. 1 is a perspective view of an embodiment of the spindle with a rod portion inserted partially into a sleeve portion.
Figure 2:
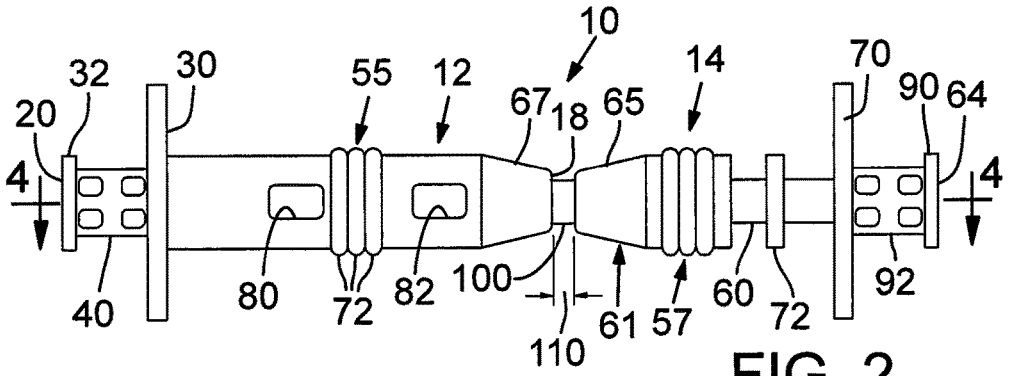
FIG. 2 is a perspective view of the embodiment of FIG. 1 with the rod portion more fully inserted into the sleeve portion.

Features and advantages of spindles in accordance with this disclosure will become more apparent from the following detailed description, which proceeds with reference to the accompanying drawings. A spindle need not have all of the features or provide all of the advantages disclosed here to be encompassed within the invention of this disclosure. The invention includes all novel and non-obvious combinations and sub-combinations of spindle features set forth herein.

Throughout this disclosure, when a reference is made to a first element being coupled to a second element, the term "coupled" is to be construed to mean both direct connection of the elements as well as indirect connection of the elements by way of one or more additional intervening elements. Also, the singular terms "a", "an", and "first", mean both the singular and the plural unless the term is qualified to expressly indicate that it only refers to a singular element, such as by using the phase "only one". Thus, for example, if two of a particular element are present, there is also "a" or "an" of such element that is present. In addition, the term "and/or" when used in this document is to be construed to include the conjunctive "and", the disjunctive "or", and both "and" and "or". Also, the terms "includes" and "has" have the same meaning as "comprises". Also, the terms "including" and "having" have the same meaning as "comprising". The term "about" means within plus or minus five percent of the stated value.

With reference to FIGS. 1-5, one embodiment 10 of a spindle assembly for supporting a roll of paper product in a paper product dispenser is shown. The roll of paper product has a spindle receiving core with an inner core diameter. The term core also includes an opening extending transversely through the center of the paper roll whether the opening is lined by a separate core or is bounded by an inner layer of the rolled paper material.

The illustrated spindle assembly embodiment comprises a sleeve or female portion 12 and a rod or male portion 14.

With reference to FIGS. 4A through 4E, the sleeve portion 12 comprises a sleeve body 16 with first and second sleeve body ends 18, 20. The sleeve body has a longitudinal axis 22 (FIGS. 4A and 4B) and has a rod receiving passageway 24 bound by an interior wall of the sleeve body 18. The rod receiving passageway 24 extends through an opening 25 in the first sleeve body end 18 and axially into the sleeve body 16. The passageway can be of any cross-sectional shape, such as circular.

Figure 3A:
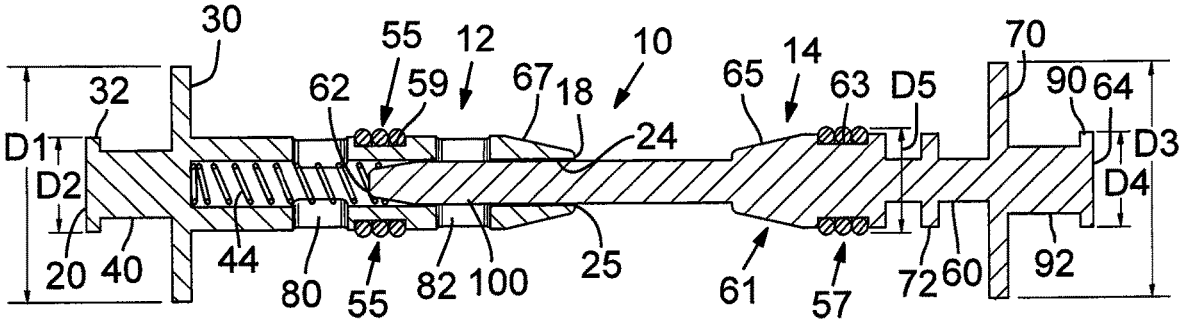
FIG. 3A is a vertical sectional view taken along lines 3A-3A of FIG. 1.

A first ring 30 extends outwardly from the sleeve body 16 and has a first maximum outer diameter D1 (FIG. 3A). Desirably, the first ring comprises a flange that is perpendicular to the longitudinal axis and can be an annular disc with planar opposed surfaces. The first ring 30 is positioned between the first and second sleeve body ends 18, 20 and is nearer to the second sleeve body end 20 than to the first sleeve body end 18. The diameter D1 is greater than the diameter of the core of the paper roll such that the outer ring, or at least a portion thereof, is restricted from insertion into the core opening extending through the paper roll to be supported by the spindle. If other than circular in shape, the first ring 30 has a cross sectional dimension, at least in segments, that desirably is large enough to prevent the insertion of the first ring entirely into the core.

In addition, with reference to FIG. 1, a second ring 32 extends outwardly from the sleeve body and is positioned at the second sleeve body end 20. The second ring 32 can also be circular in cross section with a second outer diameter or cross sectional dimension D2 (FIG. 3A) being less than the first outer diameter D1. The second ring 32 can also comprise an annular flange that extends perpendicularly to the longitudinal axis 22 of the sleeve body 16. A portion 40 of the sleeve body 16 between the first and second rings 30, 32 in the depicted embodiments has an outer cross sectional dimension that is less than the second outer diameter or cross sectional dimension. The portion 40 can fit within and slide upwardly and downwardly along a slot of a paper dispenser (e.g. slot 41 in a channel 123 of paper dispenser 42 shown in FIG. 6) such that the sleeve body can slide within the dispenser slot with portion 40 captured in the slot.

A biasing spring 44 is inserted through opening 25, which comprises a rod receiving opening, and is positioned within, and desirably at the base of, the rod receiving passageway 24. The base end of the spring is desirably held in place within the rod receiving passageway, such as press fit into a spring receiving area of the base of the rod receiving passageway of a reduced cross sectional dimension, press fit onto a projection at the base of the rod receiving passageway, or otherwise retained, such as by adhesive.

With reference to FIG. 5, the rod portion 14 of the spindle assembly comprises a rod body 60 having first and second rod body ends 62, 64 and a rod body longitudinal axis 66.

The rod body 60 comprises a third ring 70 that extends outwardly from the rod body and that has a third maximum outer diameter D3 (FIG. 3A). Desirably, the third ring comprises an annular flange that is perpendicular to the longitudinal axis 66. The flange or third ring can be an annular disc with planar opposed surfaces. When the sleeve and rod portions 12, 14 are assembled with the rod body 60 inserted into the sleeve passageway, the axes 22, 66 are aligned. The first ring 30 is positioned between the first and second rod body ends 62, 64 and is nearer to the second rod body end 64 than to the first rod body end 62. The diameter D3 is greater than the diameter of the core of the paper roll such that the outer ring 70, or at least a portion thereof, is restricted from insertion into the core opening extending through the paper roll to be supported by the spindle. If other than circular in shape, the third ring 70 has a cross sectional dimension, at least in segments, that is large enough to prevent the insertion of the third ring 70 entirely into the core. This can be seen in FIG. 6 wherein the ring 70 is prevented from entirely entering the core of the supported paper roll due to the cross sectional dimension of the ring 70. The first and third rings 30, 70 can be of the same size and shape and, if so, D1 is equal to D3.

Referring again to FIGS. 5A through 5E, one or more fourth rings, such as ring 72, can be provided and can extend outwardly from the rod body 60. The ring 72 is positioned inwardly from the ring 70 between rod end 62 and the ring 70. The outer peripheries of these rings (or ring 72 if only one is provided) comprise a surface upon which the core of the paper roll is supported and can rotate.

Figure 4A:
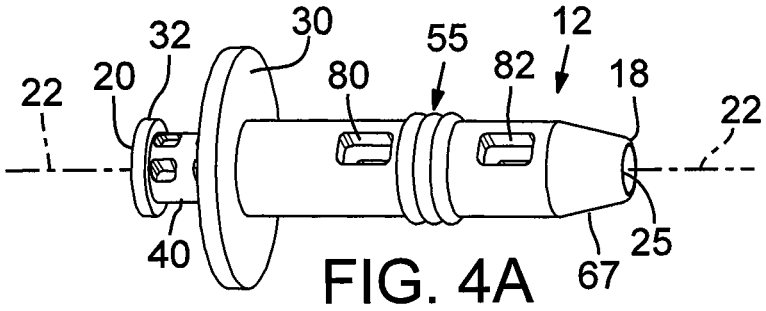
FIG. 4A is a top view of the sleeve portion of the spindle of FIG. 1, it being understood that the bottom view can be the same as the top view.
Figure 4B:
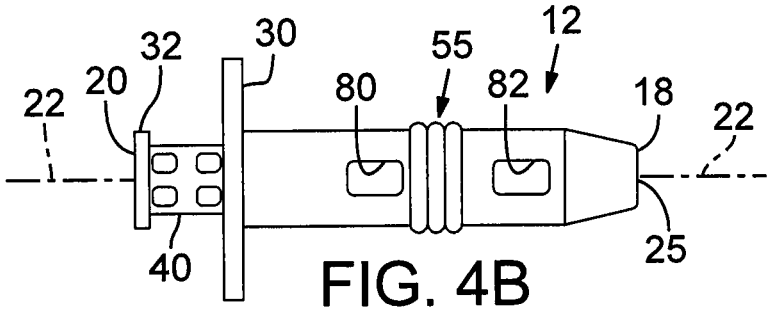
FIG. 4B is a side elevation view of one side of the sleeve portion of the spindle of FIG. 1, it being understood that the opposite side view can be the mirror image of FIG. 4B.
Figure 4C:
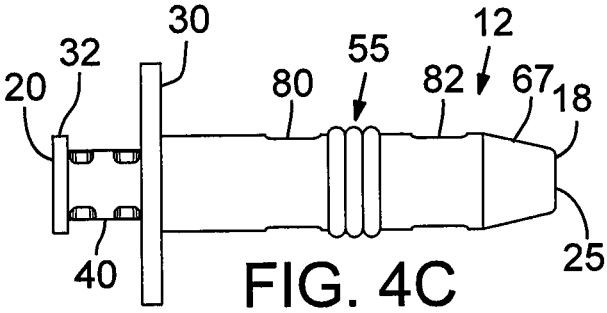
FIG. 4C is an end view of the sleeve portion of the spindle of FIG. 1 looking from the right in FIG. 4A.
Figure 4D:
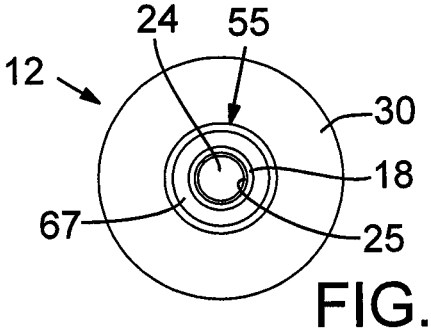
FIG. 4D is an end view of the sleeve portion of the spindle of FIG. 1 looking from the left in FIG. 4A.
Figure 4E:
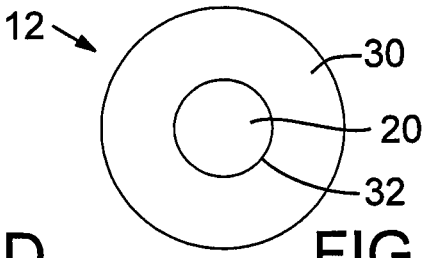
FIG. 4E is an end view of the sleeve portion of the spindle of FIG. 1 looking from the right in FIG. 4A.
Figure 5A:
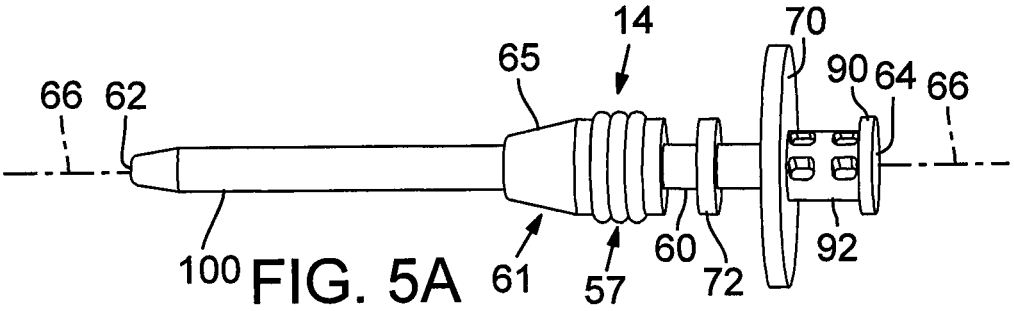
FIG. 5A is a top view of the rod portion of the spindle of FIG. 1, it being understood that the bottom view can be the same as the top view.
Figure 5B:
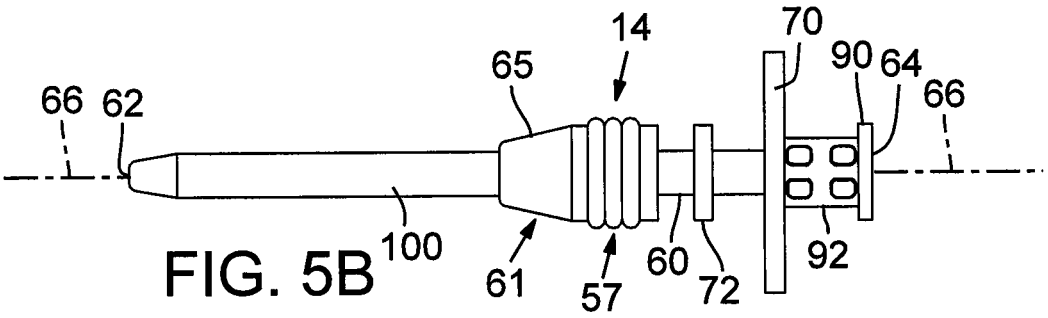
FIG. 5B is a side elevation view of one side of the rod portion of the spindle of FIG. 1, it being understood that the opposite side view can be the mirror image of FIG. 5B.
Figure 5C:
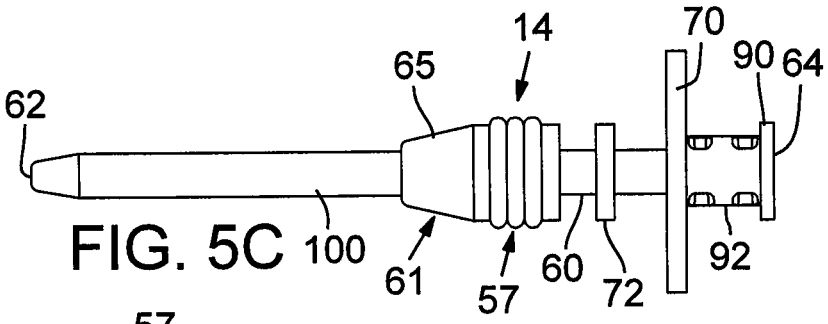
FIG. 5C is an end view of the rod portion of the spindle of FIG. 1 looking from the left in FIG. 5A.
Figure 5D:
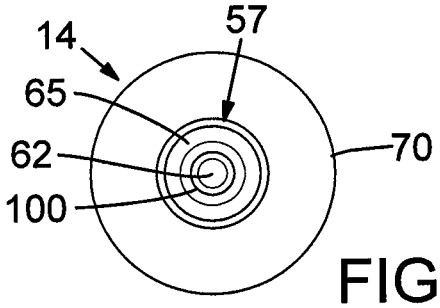
FIG. 5D is an end view of the rod portion of the spindle of FIG. 1 looking from the left in FIG. 5A.
Figure 5E:
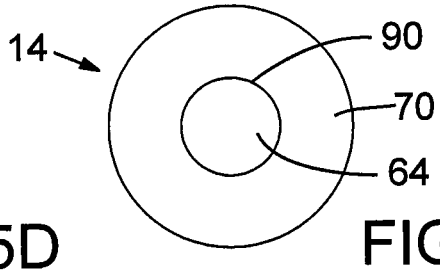
FIG. 5E is an end view of the rod portion of the spindle of FIG. 1 looking from the right in FIG. 5A.

Desirably, the outer surface of sleeve body 16, or at least a portion thereof, is cylindrical with a sleeve body diameter, such as a right cylinder (except for a tapered end and recesses therein or openings there through, such as ventilation openings 80, 82 as numbered in FIGS. 4B and 4C). The diameter of sleeve body 16 can be the same as D4. Therefore, in use the outer surface of sleeve body 16 and the outer peripheries of the ring 72 can support the paper roll along a line of support. Apart from brake members, as can be seen in FIGS. 5B and 5C, in the illustrated embodiment, there are no rings of a greater diameter than this fourth diameter D4 between the third ring 70 and the first end 62 of the rod body 60. Desirably, a portion of the outer surface of the rod body 14 is cylindrical with a greatest rod body diameter (see FIGS. 5A and 5B) that is smaller than the diameter of rod body brake members carried by the rod body as explained below.

In addition, with reference to FIG. 5, a fifth (or outer rod body) ring 90 extends outwardly from the sleeve body and is positioned at the second sleeve body end 64. The fifth ring 90 can be like the second ring 32. The fifth ring 90 can also be circular in cross section with a fifth outer diameter (or outer rod body ring diameter) or cross sectional dimension D4 being less than the first outer diameter D1. The fifth ring 90 can also be a flange that extends perpendicularly to the longitudinal axis 66 of the rod body 60. A portion 92 of the rod body 60 between the third and fifth rings 70, 90, in the depicted embodiments, has an outer cross sectional dimension that is less than the fifth outer diameter or cross sectional dimension D4. The portion 92 can fit within a slot of a paper dispenser (e.g. a slot like slot 41 in paper dispenser 42 shown in FIG. 6, but that is opposed to the slot 41) such that the rod body portion 92 can slide relative to, and along, the associated dispenser slot. The portion 92 guides the motion of the spindle and supported roll in the slot and the ring 90 captures the rod end in the dispenser slot.

Figure 3B:
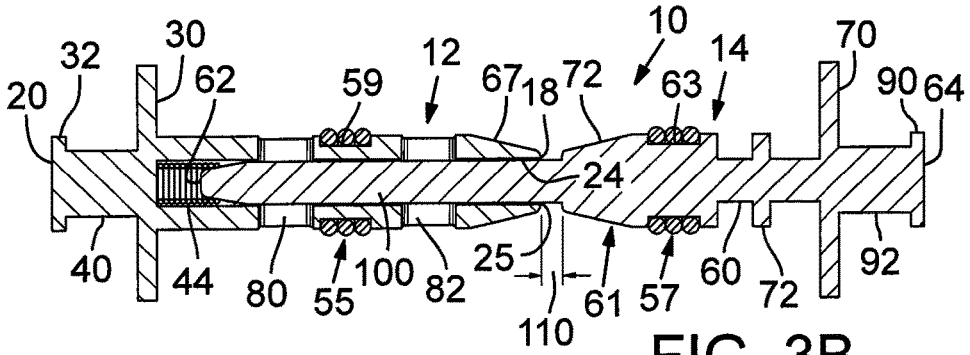
FIG. 3B is a vertical sectional view taken along lines 3B-3B of FIG. 1.

With further reference to FIGS. 3A and 3B, the rod body 60 comprises a spindle rod end portion 100 between the fourth ring 72 and the first end 62 of the rod body. A first or distal end portion of the of the spindle rod end portion 100 has a cross sectional dimension that is sized and shaped (e.g. a circular in cross section for a rod receiving passageway having a circular cross section, or a different matching cross section for a rod receiving passageway having other than a circular cross section) to permit sliding of the distal end portion 100 of the spindle rod end portion into and along the rod receiving passageway 24 upon assembly of the sleeve body and rod body portions 12, 14 into the spindle assembly. The first end 62 of the spindle rod body engages the biasing spring 44 and compresses the engaged biasing spring as the spindle rod is inserted into the rod receiving passageway (compare FIG. 3A with FIG. 3B). The compressed biasing spring 44 applies a force that urges the second and fifth rings 32, 90 away from one another and also the first and third rings 30, 70 away from one another. The second and fifth rings 32, 90 are urged against interior surfaces of respective dispenser side walls 122, 124 (FIG. 6) to thereby engage the dispenser and assist in maintaining the paper rolls in a desired non-skewed horizontal orientation in a vertically oriented dispenser.

In a desirable construction, when the spring 44 is fully compressed, there is a gap 110 (FIG. 3B) between the distal surface of the fourth ring 72 and the first end 18 of the sleeve body 16. This allows a greater range of motion of the rod body into the sleeve body than would be the case if the distal ring 72 abutted the sleeve body end 18 prior to full compression of the spring 44.

As a further aspect of this disclosure, the spindle assembly desirably includes at least one brake element or member positioned to engage the interior core of a paper roll when positioned on the spindle. The brake member can be on the sleeve body, on the rod body or at least one break member can be positions on each of the sleeve body and the rod body, such as brake members 55 and 57 in FIGS. 3A, 4B and 5B. The brake element is operable to engage and provide friction against the interior core of the paper roll to thereby limit and slow down the rate of rotation of the paper roll when a user engages and pulls on the end of the paper roll.

The brake members 55, 57 can be annular and desirably have a cross sectional dimension that is less than the cross-sectional dimension of the paper roll core. Desirably there is at least one brake member positioned on each of the rod body and sleeve body. The brake member 55 on the sleeve body is desirably positioned between the first ring 30 and the first sleeve body end 18. In addition, the brake member on the rod body is desirably positioned between the third ring 70 and the first rod body end 62 and more desirably between the fourth ring 72 and the first rod body end 62.

The brake members 55, 57 can comprise elastomeric members, such as rings. O-rings (see FIGS. 3A and 3B) or O-bands are a specific example. In one specific form, each of the brake members comprises a plurality of O-rings of rubber that are positioned side by side on the respective sleeve and rod bodies. For example, each brake member can comprise a set of three O-rings. The brake members can be held axially in position by adhesive. Alternatively, the brake member on the sleeve can be positioned in a seat 59 recessed into the sleeve body with wall portions at the axial ends of the seat 59. They can be positioned in a seat with respective wall portions at the axial ends of each seat. In addition, the brake member on the rod body be positioned in a seat 63 recessed into the sleeve body with wall portions at the axial ends of the seat 63. In addition, the seat 63 in the rod body can be positioned in a portion of the rod body that is enlarged in cross-sectional dimension, such as an annular portion spaced from the first end 62 of the rod body and that has the same diameter as the fourth ring 72. The distal end of the rod body seat nearest to the first end of the rod body can be tapered, such as frustoconical, to facilitate insertion into the interior of the paper roll. In addition, the first end or distal end of the sleeve body can also be tapered, such as frustoconical for the same reason.

The brake members 55, 57 extend outwardly beyond the respective sleeve and rod bodies to provide a paper roll engaging surface on which the paper roll rotates. For example, as shown in FIGS. 3A and 3B, in the illustrated example, the brake members 55, 57 comprise O-rings having an outside diameter D5 that is greater than D4. Consequently, the paper roll core will rest on the upper surfaces of the O-rings with the O-rings providing added friction to reduce the rate of rotation of the paper roll when paper is being pulled from the roll by a user.

With reference to FIG. 3A, in the depicted embodiment, at least a portion of the sleeve body 16 between the first ring 30 and the first sleeve body end 18 can have an outer diameter that is equal to D4, and desirably no greater than D4. Again, the sleeve body 16, apart from any openings or recesses formed in the sleeve body, can be a right cylinder. Desirably, in one form of spindle assembly, there are no rings of a greater diameter than the fourth diameter D4 between the third ring 70 and the first end 62 of the rod body.

As a further aspect of this disclosure, the spindle assembly desirably includes at least one brake element or member positioned to engage the interior core of a paper roll when positioned on the spindle. The brake member can be on the sleeve body, on the rod body or at least one break member can be positions on each of the sleeve body and the rod body, such as spindle body brake member 55 and rod body brake member 57 in FIGS. 3A, 4B and 5B. The brake element is operable to engage and provide friction against the interior core of the paper roll to thereby limit and slow down the rate of rotation of the paper roll when a user engages and pulls on the end of the paper roll.

The brake members 55, 57 can be annular and desirably have a cross sectional dimension that is less than the cross-sectional dimension of the paper roll core. Desirably there is at least one brake member positioned on each of the rod body and sleeve body. The brake member 55 on the sleeve body is desirably positioned between the first ring 30 and the first sleeve body end 18. In addition, the brake member on the rod body is desirably positioned between the third ring 70 and the first rod body end 62 and more desirably between the fourth ring 72 and the first rod body end 62.

The brake members 55, 57 can comprise elastomeric members, such as rings. O-rings (see FIGS. 3A and 3B) or O-bands are a specific example. In one specific form, each of the brake members comprises a plurality of O-rings of rubber that are positioned side by side on the respective sleeve and rod bodies. For example, each brake member can comprise a set of three O-rings. The brake members can be held axially in position by adhesive. Alternatively, the brake member on the sleeve can be positioned in a seat 59 recessed into the sleeve body with wall portions at the axial ends of the seat 59. They can be positioned in a seat with respective wall portions at the axial ends of each seat. In addition, the brake member on the rod body be positioned in a seat 63 recessed into the sleeve body with wall portions at the axial ends of the seat 63. In addition, the seat 63 in the rod body can be positioned in a portion of the rod body that is enlarged in cross-sectional dimension, such as an annular portion spaced from the first end 62 of the rod body and that has the same diameter as the fourth ring 72. The distal end of the rod body seat nearest to the first end of the rod body can be tapered, such as frustoconical, to facilitate insertion into the interior of the paper roll. In addition, the first end or distal end of the sleeve body can also be tapered, such as frustoconical for the same reason.

The brake members 55, 57 extend outwardly beyond the respective sleeve and rod bodies to provide a paper roll engaging surface on which the paper roll rotates. For example, as shown in FIGS. 3A and 3B, in the illustrated example, the brake members 55, 57 can be annular and can comprise O-rings having an outside diameter D5 that is greater than D4. Consequently, the paper roll core will rest on the upper surfaces of the O-rings with the O-rings providing added friction to reduce the rate of rotation of the paper roll when paper is being pulled from the roll by a user.

With reference to FIG. 1, the spindle assembly can comprise a plurality of rings e.g. rings 30, 32, 72, 70 and 90 that each can be annular, coaxial and have a geometric center intersected by the longitudinal axis through the assembled spindle (e.g. coaxial axes 22, 66). Each of the rings can project perpendicularly outwardly from the longitudinal axis. The illustrated brake members have a diameter that is greater than the diameter of any rings between rings 30 and 70.

Figure 6:
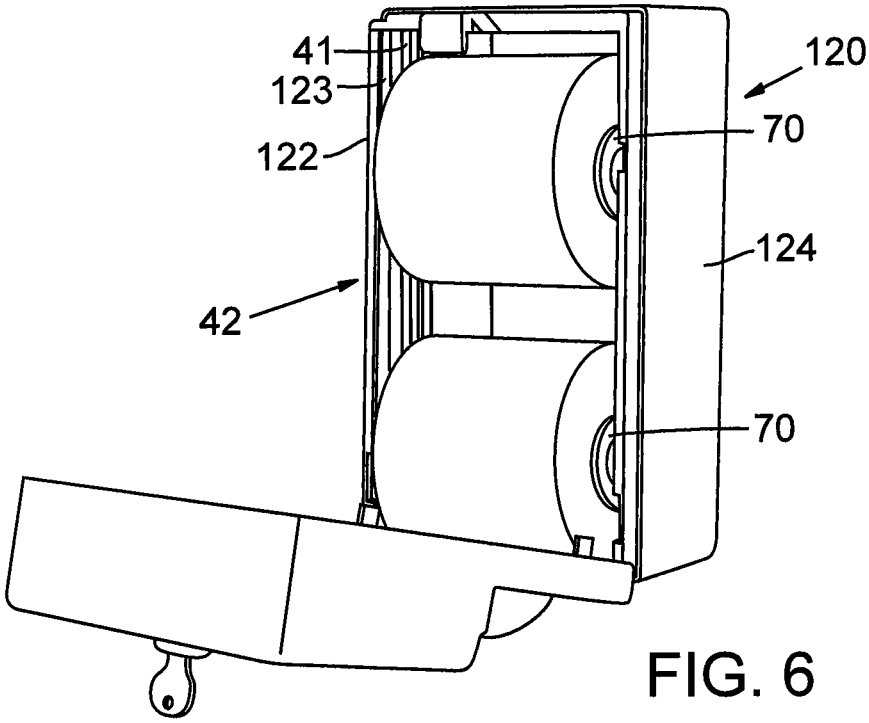
FIG. 6 illustrates an exemplary paper dispenser with paper rolls, in this example two toilet paper rolls, positioned on respective spindles of the embodiment of FIG. 1 and positioned in the dispenser.

With reference to FIG. 6, the paper dispenser 42 can comprise a toilet paper dispenser comprising a housing 120 having a first side wall 122 with a first channel 123 defined by channel walls that are mounted to the first side wall. The housing can also have a second side wall 124 opposed to the first side wall 122. The second side wall has a second channel mounted thereto (not shown), that can be like the first channel 123, but opposed to the first channel. The first channel has a first spindle receiving slot 41 extending lengthwise along the first side wall 122 that is oriented vertically in this example when the housing 120 is mounted for use. The second channel has a second spindle receiving slot facing the first spindle receiving slot. The second spindle receiving slot is spaced from the first spindle receiving slot by a spacing distance that is less than the distance between the second end 20 of the sleeve body 16 and the second end 64 of the rod body 60 when the spindle rod end portion 100 is initially inserted into the rod receiving passageway 24, for example to its most limited depth of insertion, and the spindle rod end portion has not compressed the spring 44. This spacing distance between the opposed slots is also greater than the distance between the second end 20 of the sleeve body 16 and the second end 64 of the rod body 60 when the spindle rod end portion is inserted a maximum distance into the rod receiving passageway 24 (see FIG. 3B) and compresses the spring. The paper roll in this example is carried by the spindle assembly with the first and third rings 30, 70 limiting axial sliding of the paper roll against the housing walls. In addition, the respective sleeve portion 40 and rod body portion 92, and the second and fifth rings 32 90, are positioned within their associated slots. When the spindle and paper roll is loaded into the dispenser, the spring 44 is operable to urge the second and fifth rings 32, 90 against surfaces of a portion of the dispenser inside the channels, such as portions of the interior side walls of the dispenser to retain the spindle supported paper roll in a desired horizontal orientation in the dispenser housing 120.

The illustrated spindle assembly has ornamental features as the functional aspects of the design can be accomplished in spindle assemblies with different features. Also, the design includes the spindle and rod elements separately as well as in an assembly. In addition, the brake elements and openings shown in the spindle and rod bodies can be dashed as they do not form a part of the ornamental design.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A spindle assembly for supporting a roll of paper product in a paper product dispenser, the roll of paper product having a spindle receiving core with an inner core diameter, the spindle assembly comprising:

a sleeve body having first and second sleeve body ends and a sleeve body longitudinal axis, the sleeve body having a rod receiving passageway extending through the first sleeve body end and axially into the sleeve body;

a first ring extending outwardly from the sleeve body and having a first outer diameter, the first ring being positioned between the first and second sleeve body ends and nearer to the second sleeve body end than to the first sleeve body end;

a second ring extending outwardly from the sleeve body positioned at the second sleeve body end, and having a second outer diameter, the second outer diameter being less than the first outer diameter;

the portion of the sleeve body between the first and second rings having an outer diameter that is less than the second outer diameter;

a biasing spring positioned within the rod receiving passageway;

a rod body having first and second rod body ends and a rod body longitudinal axis;

a third ring extending outwardly from the rod body and having a third outer diameter, the third ring being positioned between the first and second rod body ends and nearer to the second rod body end than to the first rod body end;

at least one fourth ring extending outwardly from the rod body and having a fourth outer diameter, there being no rings of a greater diameter than the fourth outer diameter between the third ring and the first end of the rod body;

a fifth ring extending outwardly from the rod body and having a fifth outer diameter, the fifth ring being located at the second rod body end, the fifth outer diameter being less than the third outer diameter;

the portion of the rod body between the third and fifth rings having an outer diameter that is less than the fifth outer diameter;

the rod body comprising a spindle rod portion between the at least one fourth ring and the first end of the rod body comprising a first end of the spindle rod portion, the first end of the spindle rod portion and the spindle rod portion having a cross sectional dimension that is sized to permit sliding of the spindle rod portion into and along the rod receiving passageway upon assembly of the sleeve body and rod body into the spindle assembly, the first end of the spindle rod portion engaging the biasing spring and compressing the engaged biasing spring as the spindle rod portion is inserted into the rod receiving passageway, the compressed biasing spring applying a force that urges the second and fifth rings away from one another; and at least one of the sleeve body and rod body comprising a brake member having a diameter configured to engage the core of a paper roll when supported by the spindle assembly.

2. A spindle assembly according to claim 1 wherein a spindle body brake member is carried by the spindle body and a rod body brake member is carried by the rod body, the spindle body brake members and rod body brake members having a larger diameter than other portions of the spindle assembly between the first and third rings.

3. A spindle assembly according to claim 2 wherein the rod body brake member and the spindle body brake member each comprise a plurality of O-rings.

4. A spindle assembly according to claim 1 wherein the first and third outer diameters are equal to one another.

5. A spindle assembly according to claim 1 wherein at least a portion of the sleeve body between the first ring and the first sleeve body end has an outer diameter that is equal to the fourth outer diameter.

6. A spindle assembly according to claim 1 wherein each of the rings are annular, coaxial and have a geometric center intersected by the longitudinal axis.

7. A spindle assembly according to claim 1 wherein each of the rings project perpendicularly outwardly from the longitudinal axis.

8. A spindle according to claim 1 wherein the roll of paper product is a roll of toilet tissue.

9. A spindle assembly for supporting a roll of paper product in a paper product dispenser, the roll of paper product having a spindle receiving core with an inner core diameter, the spindle assembly comprising:

a sleeve body having first and second sleeve body ends and a sleeve body longitudinal axis, the sleeve body having a rod receiving passageway extending through the first sleeve body end and axially into the sleeve body;

a sleeve body brake member carried by the sleeve body;

a first ring extending outwardly from the sleeve body and having a first outer diameter, the first ring being positioned between the first and second sleeve body ends and nearer to the second sleeve body end than to the first sleeve body end;

a second ring extending outwardly from the sleeve body and positioned at the second sleeve body end, the second ring having a second outer diameter that is less than the first outer diameter;

a biasing spring positioned within the rod receiving passageway;

wherein the sleeve body comprises an annular sleeve body recess between the first ring and the first sleeve body end, and the sleeve body brake member comprises a plurality of O-rings positioned in the sleeve body recess;

a rod body having first and second rod body ends and a rod body longitudinal axis;

a third ring extending outwardly from the rod body and having a third outer diameter, the third ring being positioned between the first and second rod body ends and nearer to the second rod body end than to the first rod body end;

an outer rod body ring extending outwardly from the rod body and having an outer rod body ring outer diameter, the outer rod body ring being located at the second rod body end, the outer rod body ring outer diameter being less than the third outer diameter;

a rod body brake member carried by the rod body; and the rod body comprising a spindle rod portion between the third ring and the first end of the rod body, the first end of the rod body comprising a first end of the spindle rod portion, the first end of the spindle rod portion and the spindle rod portion having a cross sectional dimension that is sized to permit sliding of the spindle rod portion into and along the rod receiving passageway upon assembly of the sleeve body and rod body into the spindle assembly, the first end of the spindle rod portion engaging the biasing spring and compressing the engaged biasing spring as the spindle rod portion is inserted into the rod receiving passageway, the compressed biasing spring applying a force that urges the second ring and the outer rod body ring away from one another;

wherein the rod body comprises an annular rod body recess between the third ring and the first rod body end, and the rod body brake member comprises a plurality of O-rings positioned in the rod body recess; and the sleeve body brake member and rod body brake member being sized to engage and support the core of a paper roll on the spindle assembly.

10. A spindle assembly according to claim 9 wherein at least a portion of the sleeve body between the first ring and first sleeve body end is a right cylinder that has a sleeve body diameter, and wherein the sleeve body brake member is annular and has a sleeve brake member diameter that is greater than the sleeve body diameter, and wherein at least a portion of the rod body between the third ring and the first rod body end is a right cylinder that has a rod body diameter, and wherein the rod body brake member has a rod body brake member diameter that is greater than the rod body diameter.

11. A spindle assembly according to claim 10 wherein the sleeve body diameter and the rod body diameter are the same and wherein a sleeve body brake member diameter and a rod body brake member diameter are the same, and wherein the rod body brake member diameter and the sleeve body brake member diameter are of a greater diameter than portions of the sleeve body diameter, and wherein the first and third outer diameters are the same.

12. A spindle assembly according to claim 9 comprising a fourth ring extending outwardly from the rod body between the third ring and the rod body brake member, the fourth ring having a fourth diameter.

13. A spindle assembly according to claim 12 wherein there are no rings of a greater diameter than the fourth diameter between the third ring and the first end of the rod body.

14. A spindle assembly according to claim 13 wherein the rod body brake member has a rod body brake member diameter that is greater than the fourth diameter.

15. A spindle assembly according to claim 9 wherein each of the rings are annular, coaxial and have a geometric center intersected by the longitudinal axis, and wherein each of the rings project perpendicularly outwardly from the longitudinal axis, and wherein the rod body brake member and sleeve body brake member each project further from the longitudinal axis than any other portions of the spindle assembly positioned between the first and third rings.

16. A spindle assembly according to claim 9 wherein the first sleeve body end is frustoconical and wherein a portion of the rod body between the rod body recess and first rod body end is frustoconical.

17. A spindle assembly for supporting a roll of toilet paper in a toilet paper dispenser in combination with the toilet paper dispenser, the roll of toilet paper having a spindle receiving core with an inner core diameter, the spindle assembly comprising:

a sleeve body having first and second sleeve body ends and a sleeve body longitudinal axis, the sleeve body having a rod receiving passageway extending through the first sleeve body end and axially into the sleeve body;

a first ring extending outwardly from the sleeve body and having a first outer diameter, the first ring being positioned between the first and second sleeve body ends and nearer to the second sleeve body end than to the first sleeve body end;

a second ring extending outwardly from the sleeve body positioned at the second sleeve body end, and having a second outer diameter, the second outer diameter being less than the first outer diameter;

the portion of the sleeve body between the first and second rings having an outer diameter that is less than the second outer diameter;

an annular sleeve body brake member carried by the sleeve body, the sleeve body brake member having a diameter that is greater than any portions of the sleeve body between the first ring and the first sleeve body end;

a biasing spring positioned within the rod receiving passageway;

a rod body having first and second rod body ends and a rod body longitudinal axis;

a rod body brake member carried by the rod body;

a third ring extending outwardly from the rod body and having a third outer diameter, the third ring being positioned between the first and second rod body ends and nearer to the second rod body end than to the first rod body end;

a fourth ring extending outwardly from the rod body and having a fourth outer diameter, there being no rings of a greater diameter than the fourth outer diameter between the third ring and the first end of the rod body, the rod body brake member being annular with a diameter that is greater than the fourth outer diameter;

a fifth ring extending outwardly from the rod body and having a fifth outer diameter, the fifth ring being located at the second rod body end, the fifth outer diameter being less than the third outer diameter;

the portion of the rod body between the third and fifth rings having an outer diameter that is less than the fifth outer diameter; and the rod body comprising a spindle rod portion between the fourth ring and the first end of the rod body comprising a first end of the spindle rod portion, the first end of the spindle rod portion and the spindle rod portion having a cross sectional dimension that is sized to permit sliding of the spindle rod portion into and along the rod receiving passageway upon assembly of the sleeve body and rod body into the spindle assembly, the first end of the spindle rod portion engaging the biasing spring and compressing the engaged biasing spring as the spindle rod portion is inserted into the rod receiving passageway, the compressed biasing spring applying a force that urges the second and fifth rings away from one another; and the toilet paper dispenser comprising a housing having a first side wall with a first channel mounted to the first side wall and a second side wall opposed to the first side wall, a second channel being mounted to the second side wall, the first channel having a first spindle receiving slot and the second channel having a second spindle receiving slot facing the first spindle receiving slot, the second spindle receiving slot being spaced from the first spindle receiving slot by a spacing distance that is less than the distance between the second end of the sleeve body and the second end of the rod body when the spindle rod portion is inserted into the rod receiving passageway and the spindle rod portion has not compressed the spring, the spacing distance also being greater than the distance between the second end of the sleeve body and the second end of the rod body when the spindle rod portion is inserted a maximum distance into the rod receiving passageway and compresses the spring, the toilet paper roll being carried by the spindle assembly with the first ring being positioned between the first channel and the toilet paper roll and the third ring being positioned between the second channel and the toilet paper roll, the toilet paper roll being positioned between the first and third rings and supported by the sleeve body brake member and by the rod body brake member, the second and fifth rings being respectively positioned in the first and second slots to load the toilet paper dispenser with the roll of toilet paper, the spring urging the second and fifth rings against surfaces of the channels or of the dispenser to hold the toilet paper roll in a desired orientation in the dispenser.

* * * * *